US008283098B2

(12) United States Patent
Kouyama et al.

(10) Patent No.: US 8,283,098 B2
(45) Date of Patent: Oct. 9, 2012

(54) PRODUCTION METHOD OF TONER, TONER AND DEVELOPER

(75) Inventors: Mikio Kouyama, Tokyo (JP); Kenji Hayashi, Tokyo (JP); Hiroaki Obata, Tokyo (JP); Noriyuki Kimpara, Tokyo (JP); Hiroshi Nagasawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 542 days.

(21) Appl. No.: 12/605,762

(22) Filed: Oct. 26, 2009

(65) Prior Publication Data

US 2010/0112473 A1 May 6, 2010

(30) Foreign Application Priority Data

Nov. 4, 2008 (JP) ..... 2008-282942

(51) Int. Cl.
*G03G 9/087* (2006.01)

(52) U.S. Cl. ..... 430/109.3; 430/137.15

(58) Field of Classification Search ..... 430/109.3, 430/137.15

See application file for complete search history.

(56) References Cited

U.S. PATENT DOCUMENTS

2006/0154164 A1* 7/2006 Kidokoro ..... 430/108.23

FOREIGN PATENT DOCUMENTS

JP 61110156 5/1986
JP 9204071 8/1997

* cited by examiner

*Primary Examiner* — Hoa V Le
(74) *Attorney, Agent, or Firm* — Lucas & Mercanti, LLP

(57) ABSTRACT

A preparation method of a toner comprising a binder resin and a colorant is disclosed, comprising forming resin particles containing a resin formed by allowing a styrene monomer, a (meth)acryl monomer and a polymer represented by the formula (1) to react, and mixing the resin particles with colorant particles which were dispersed and allowing the resin particles and the colorant particle to coagulate and fuse to form toner particles, $$X—(Y)_n—X \qquad \text{formula (1)}$$

wherein X is at least one of an acryloyl group and a methacryloyl group, Y is a radical polymerizable monomer unit and n is an integer of 25 to 1000.

9 Claims, 3 Drawing Sheets

PRODUCTION METHOD OF TONER, TONER AND DEVELOPER

CROSS REFERENCE TO RELATED APPLICATIONS

This Application claims the benefit of priority of Japanese Patent Application No. 2008-282942 filed Nov. 4, 2008 the entire contents of which are hereby incorporated by reference.

FIELD OF THE INVENTION

The present invention relates to a method of producing a dry process toner containing a colorant and a binder resin and in particular to a method of a dry process toner comprising a binder resin including a resin formed by a specific polymer.

BACKGROUND OF THE INVENTION

Generally, in an electrophotographic image forming method, printed materials are prepared via the steps set forth below. First, a photoreceptor is exposed to light to form a latent image on the photoreceptor and then, a toner is supplied onto the photoreceptor to develop the latent image to form a toner image. Subsequently, the toner image on the photoreceptor is transferred to a transfer material such as paper and the transferred image is subjected to heating or pressure to fix the toner image, whereby a printed material is prepared. Further, after transfer of the toner image, a toner remained on the photoreceptor is removed by a cleaning device, rendering it feasible to perform subsequent image formation.

Recently, full-color print making by using plural kinds of color toners has been conducted and to perform efficient preparation of full-color prints, however, speedup image formation has been sought. To achieve high-speed print making, toners have been required to achieve faster electric-charging capability and rapid fixability. Further, from the view-point of enhancement of fixability, reduction of consumed energy in image formation is required from the consciousness of the global environment. Accordingly, there has been noted development of a toner corresponding to a technique of so-called low-temperature fixing.

A toner image formed on transfer paper is required to be melted in a state exhibiting a certain extent of viscosity under a prescribed condition and strong adhesion to the transfer paper. In cases when only the toner on the image surface is melted and the toner on the transfer paper side is only softened while the toner image passes through a fixing device, the toner which has been transferred to a transfer paper does not completely melt and does not achieve sufficient adhesion onto a transfer paper. Consequently, a toner image on the transfer paper adheres to a heating roller via a melted toner, causing image staining, so-called cold offset. Alternatively when a toner melts to such an extent that the viscosity of the toner is greatly reduced, a melted toner image ruptures and is transferred onto both the transfer paper and the fixing roller, causing image staining, so-called hot offset offset.

Thus, to achieve high-speed print making and low temperature fixability, a toner is required perform melting in a state exhibiting a certain extent of viscosity and strong adhesion onto transfer paper, so that offset resistance performance to inhibit occurrence of image staining due to melting troubles of a toner is also desired. Accordingly, a physical property of a binder resin with respect to heat has become one of the important factors affecting offset resistance. Further, such a physical property of a binder resin with respect to heat is one of important factors to achieve low temperature fixing.

Thus, a toner capable of achieving both low temperature fixability and offset resistance has been desired and there has been studied designing a toner to resolve this problem with noting a binder resin constituting such a toner. Examples thereof include control of a low molecular weight component and a high molecular weight component in the binder resin and introduction of a crosslinking structure. Specifically, there was disclosed a technique of a toner employing a binder resin obtained by use of a styrene-acrylic acid copolymeric resin having a broad molecular weight distribution without a high molecular weight region and a metal compound in which a crosslinking structure was formed between carboxyl groups of the polymer and the metal compound (as described in JP 61-110156A). This technique intended to achieve enhanced offset resistance substantially by an increased molecular weight of a binder resin through formation of a crosslinking structure, however, an increased amount of the metal compound caused a catalytic action, resulting in gelation of the resin and leading to inhibition of fixing.

There was also studied designation of a toner corresponding to low temperature fixability by controlling the acid value, the hydroxyl group value and the molecular weight distribution of a polyester resin, and components insoluble in tetrahydrofuran as described in JP 9-204071). However, it was proved that this technique resulted in lowering of the melting temperature, leading to reduced offset resistance.

Thus, noting a binder resin as a toner constituent, studies of a toner capable of achieving both low temperature fixability and offset resistance have been made but further investigation is required.

SUMMARY OF THE INVENTION

In view of the foregoing problems, it is an object the present invention to provide a toner which achieves both low temperature fixability and offset resistance. Specifically, it is an object to provide a toner capable of achieving superior fixing without causing image staining such as cold offset or hot offset and allowing a toner image to be sufficiently adhered to transfer paper even at a relatively low temperature.

Thus, one aspect of the present invention is directed to a method of preparing a toner comprising a binder resin and a colorant, the method comprising the steps of:

forming resin particles containing a resin (A) formed by allowing a styrene monomer, a (meth)acryl monomer and a polymer represented by the following formula (1) to react, and mixing the resin particles with colorant particles which were dispersed and allowing the resin particles and the colorant particle to coagulate and fuse to form toner particles;

$$X—(Y)_n—X \qquad \text{formula (1)}$$

wherein X is at least one of an acryloyl group and a methacryloyl group, Y is a radical polymerizable monomer unit and n is an integer of 25 to 1000, and wherein the resin (A) formed by allowing a styrene monomer, a (meth)acryl monomer and a polymer represented by the following formula (1) to react is formed by a process of dispersing the styrene monomer and the (meth)acryl monomer in an aqueous medium and polymerizing said monomers in the presence of the polymer of the formula (1) in the aqueous medium.

Another aspect of the invention is directed to a toner comprising a binder resin and a colorant which is formed by allowing at least resin particles and colorant particles to coagulate and fuse, wherein the resin particles comprise a resin formed by allowing a polymer represented by the following formula (1), a styrene monomer and a (meth)acryl monomer to react:

$$X—(Y)_n—X \quad \text{formula (1)}$$

wherein X is at least one of an acryloyl group and a methacryloyl group, and n is an integer of 25 to 1000, and the binder resin exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2.

Another aspect of the invention is directed to a developer comprising a toner, as described above.

Another aspect of the present invention is directed to an image forming method comprising the steps of:

forming an electrophotographic latent image on the surface of an electrophotographic, photoreceptor, developing the electrophotographic latent image formed on the surface of an electrophotographic photoreceptor to form a toner image, transferring the toner image onto the surface of a transfer material, and thermally fixing the toner image transferred onto the transfer material, wherein the toner comprises a binder resin and a colorant, and the binder resin is one which is formed of a resin prepared by a process of allowing a styrene monomer and a (meth)acryl monomer to polymerize in the presence of a polymer represented by the foregoing formula (1).

The present invention enabled to provide a toner which achieves both low temperature fixability and offset resistance. Thus, the problems described earlier were resolved by the use of a resin formed by using a polymer having an acryloyl group or a methacryloyl group at the end of its molecular chain, which is also called a telechelic polymer. Further, in the toner of the invention, the number average molecular weight and the ratio of Mw/Mn were each specified. Specifically, superior fixing was achieved without image staining due to a fixing temperature, so-called cold offset and hot offset, and a toner image was transferred onto a transfer paper at a relatively low temperature. Further, there was provided a toner exhibiting superior thermal storage stability, which was presumed to be attributed to uniform shell formation on the core surface when forming a toner having a core/shell structure.

DETAILED DESCRIPTION OF THE INVENTION

Figure 1:
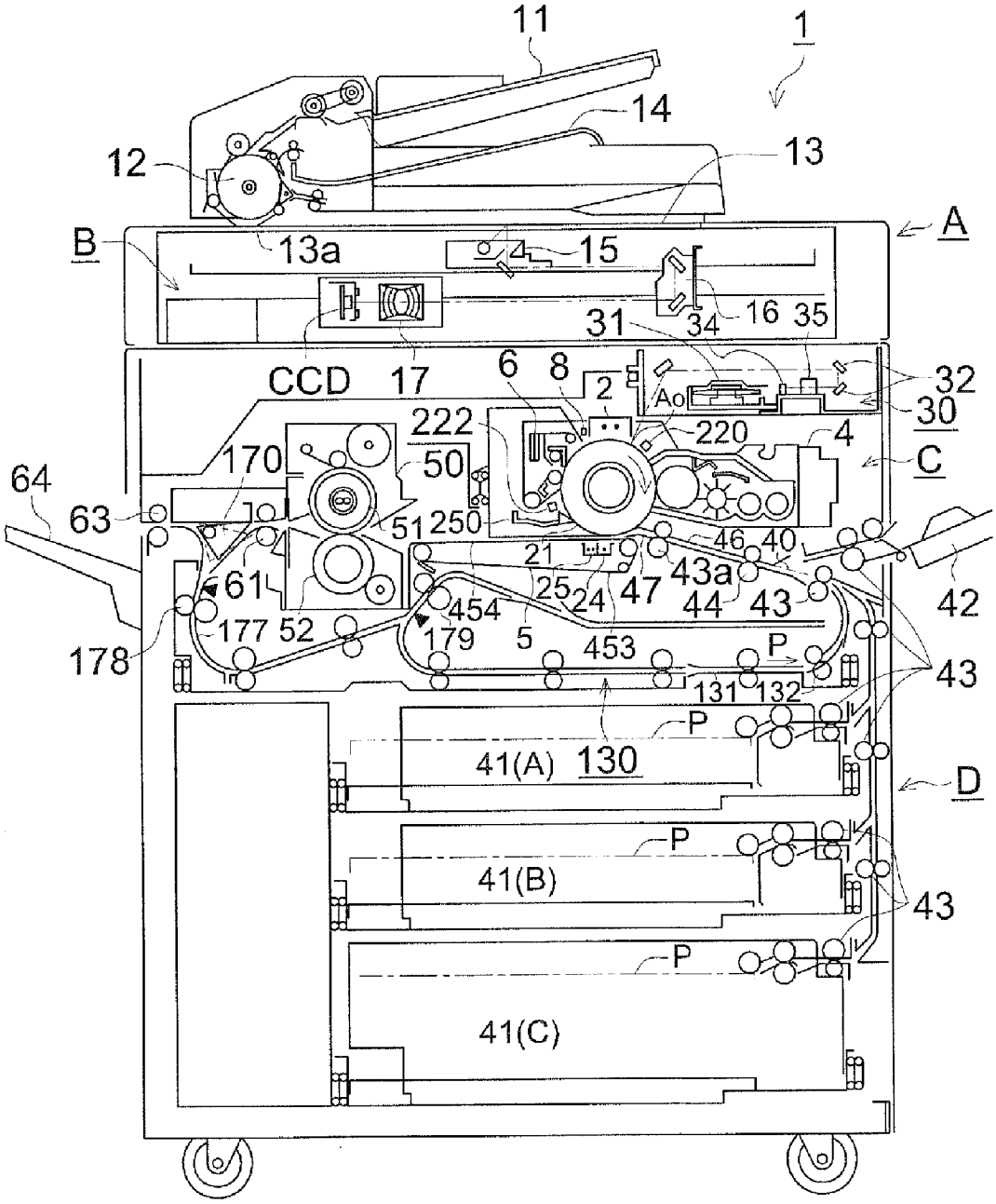
FIG. 1 illustrates an example of a black-and-white type image forming apparatus.

The present invention relates to a toner comprising at least a colorant and a binder resin and a production method thereof.

The toner of the present invention comprises at least a binder resin and a colorant, in which the binder resin comprises a resin which is prepared by using a polymer represented by the above-described formula (1) and the use of such the toner enabled to achieve both enhanced low temperature fixability and improved offset resistance. The use of a polymer having an Mn of not less than 5,000 and not more than 50,000 and a ratio (Mw/Mn) of 1.0 to 1.2 is preferred in the present invention.

It is assumed that the presence of a polymer represented by the formula (1) forms a moderate crosslinking structure between binder resin-constituting molecular chains, rendering it feasible to achieve enhanced low temperature fixability and improved offset resistance. Thus, in the polymer of the formula (1), the portion represented by "Y" exhibits a certain extent of flexibility so that even when forming a crosslinking structure, molecular chains constituting the binder resin are still in a state of being movable to a certain extent and the binder resin is fusible at a relatively low temperature, achieving enhanced low temperature fixability. Further, it is assumed that when a toner image is used in an environment of high temperature and high humidity or in an ordinary environment, the presence of the crosslinking structure restrains the movement of the binder resin-constituting molecular chains, resulting in a decreased degree of freedom of mobility and leading to improved offset resistance. Specifically, it is assumed that, when a polymer of the formula (1) is highly mono-dispersed, a crosslinking structure having regular configuration and flexibility is formed, and further enhanced low temperature fixability and improved offset resistance can be achieved.

It is also assumed that when a binder resin of a toner falls within the above-defined range regarding number average molecular weight Mn and ratio of Mw/Mn, it contributes to further enhanced thermal stability of the binder resin and also results in enhanced elasticity of the binder resin, leading to further enhanced advantageous effects of the invention. Thus, the use of a resin of a monodisperse molecular weight distribution results in an increased number of molecular chains having chain lengths of close levels, and the pattern of entangled molecular chains becomes uniform. It is contemplated that in constituting molecules of a binder resin of the prior art, the molecular weight or the molecular weight distribution varies greatly, easily causing irregular entanglement of molecular chains, so that a large amount of energy is required to resolve such entanglement of various patterns, leading to required higher fixing temperature.

In the present invention, irregular entanglement of molecular chains does not readily occur and rupture of molecular chains, caused by entanglement at the position in which molecular chains are strongly entangled, does not easily occur, resulting in no generation of radicals due to molecular chain rupture, promoting stabilization of the resin. Thus, it is assumed that radicals generated in molecular chain rupture deteriorates a binder resin, rendering it difficult to result in inherent performance of a resin. Generation of radicals in a binder resin results in expanded molecular weight distribution or causes interaction between radicals and a charging agent, rendering it difficult to achieve inherent performance of the toner. Even in a toner formed via an emulsion aggregation process, it is contemplated that molecular chain rupture occurred by stress applied in the course of image formation or the like, rendering it difficult to achieve inherent performance of the toner.

There will be further detailed the present invention.

First, there will be described "both end (meth)acryloyl telechelic polymer" of a polymer represented by the formula (1).

The polymer of the formula (1) is called "both end (meth) acryloyl telechelic polymer", which is constituted of (meth) acryloyl groups at both ends of the structure and a polymer formed by radical polymerization in the middle of the structure. In the present invention, a polymer portion formed by radical polymerization, designated by "Y" in the middle of the structure is called a radical-polymerizable monomer unit. In the polymer represented by the formula (1), "a group of at least either an acryloyl group or a methacryloyl group" represented by "X" is also described as "(meth)acryloyl group".

The foregoing "both end (meth)acryloyl telechelic polymer" may be formed by the methods known in the art and is formed preferably by a polymerization method, called a living radical polymerization. In living radical polymerization, firstly, a vinyl monomer is polymerized to form a main chain constituting a polymer. Further, at least two polymers carrying a carbon-carbon double bond are added at the terminal point of polymerization to form terminuses, which is in the form of a chain-elongated polymer or a star-form polymer. This polymer formed by the living radical polymerization, which can easily form a monodisperse molecular chain exhibiting a Mw/Mn of 1.0 to 1.2 and can also easily prepare a binder resin constituting the toner relating to the invention, is preferable in the present invention.

A portion other than both ends of the polymer is formed preferably by using a radical-polymerizable vinyl monomer, and a portion formed by using a vinyl monomer may also be denoted a radical-polymerizable monomer unit. A monomer capable of forming a portion other than both ends of the polymer is at least a composition selected from a (meth) acrylic acid monomer, a styrene monomer, a fluorine-containing vinyl monomer, a fluorine-containing vinyl monomer, anhydrous maleic acid, maleic acid, a mono- or di-alkyl ester of maleic acid, fumaric acid, a mono- or di-alkyl ester of fumaric acid, maleimide monomer, nitrile group-containing vinyl monomer, an amido group-containing vinyl monomer, vinyl esters, alkenes, conjugated dienes and allylalcohols.

In the following, structural formulas of the foregoing "both end (meth)acryloyl telechelic polymer" represented by the general formula (1) in which "n" is not less than 25 and not more than 1000 are shown, but polymers of the formula (1), usable for the toner relating to the present invention are not limited to these. In the formula (1), "n" attached to a "Y" portion of a polymer, which is not less than 25 and not more than 1000, is a median value. Polymers shown below include those carrying plural portions corresponding to the "Y" of the structural formula. The number of monomers of the individual radical-polymerizable monomer units is denoted as n1, n2, n3 and the like. Namely, in the case of one constituted of two or more radical-polymerizable monomer units, for example, in the case of one constituted of three radical-polymerizable monomer units, as shown in (1)-26, the sum of n1, n2 or n3 is not less than 25 and not more than 1000, and n1, n2, and n3 are each a median value.

(1)-1

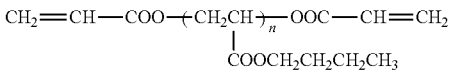

(1)-2

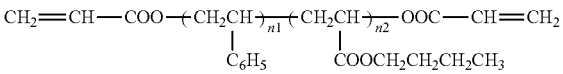

(1)-3

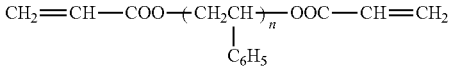

(1)-4

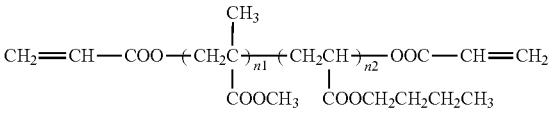

(1)-5

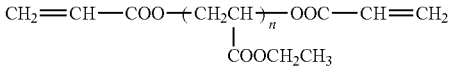

(1)-6

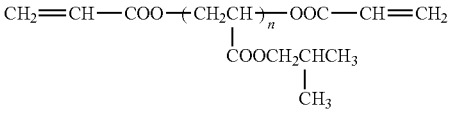

(1)-7

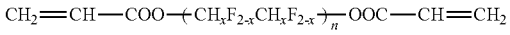

(where x is 0, 1 or 2)

(1)-8

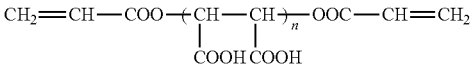

(1)-9

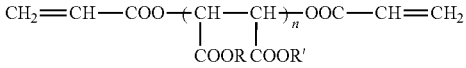

(where R and R′ are each a hydrogen atom or an alkyl group)

(1)-10

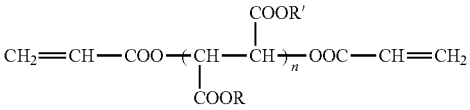

(where R and R′ are each a hydrogen atom or an alkyl group)

(1)-11

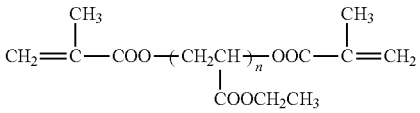

(1)-12

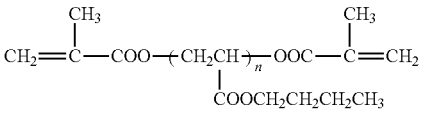

(1)-13

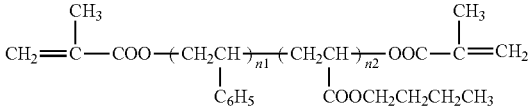

(1)-14

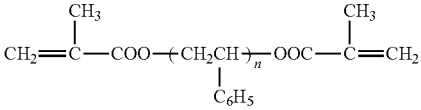

-continued (1)-15

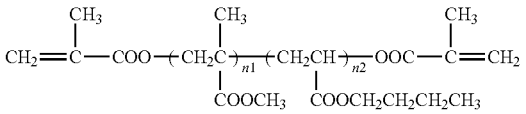

(1)-17

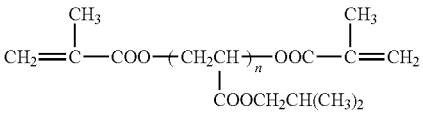

(1)-18

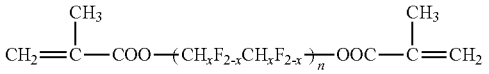

(where x is 0, 1 or 2)

(1)-19

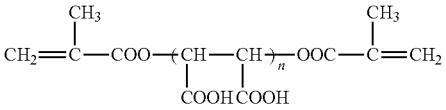

(1)-20

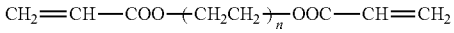

(1)-21

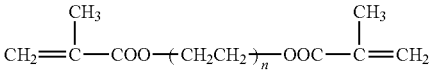

(1)-22

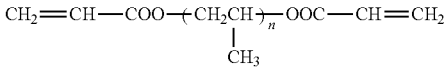

(1)-23

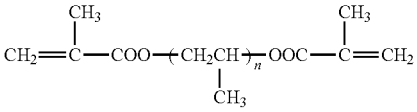

(1)-24

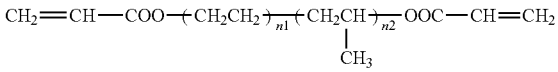

(1)-25

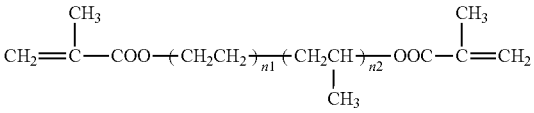

(1)-26

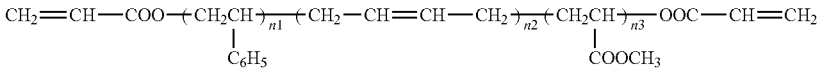

In the following, living radical polymerization will be described, which is one of the preferable method of forming a polymer of the formula (1). The living radical polymerization refers to radical polymerization maintained without losing activity of the polymerization terminus. In a narrow sense, polymerization is performed, while the terminal continues to have activity at any time. In general, pseudo-living radical-living radical polymerization is also included, in which polymerization is continued, while an inactivated terminal and an activated terminal are in equilibrium. The definition of living radical polymerization in the present invention falls within the latter case.

Examples of living radical polymerization include (1) the use of a radical scavenger such as a cobalt porphyrin complex or a nitroxide compound (as described in, for example, J. Am. Chem. Soc. 1994, 116, 7943; Macromolecules, 1994, 27, 7228); (2) atom transfer radical polymerization in which an organic halogen compound or the like is used as an initiator and a transition metal complex is used as a catalyst (as described in Atom Transfer Radical Polymerization).

Atom transfer radical polymerization is polymerization which is performed using an organic halogen compound, a halogenated sulfonyl compound or the like, as an initiator and a metal complex containing a transition metal, as a catalyst. Detailed explanation of the atom transfer radical polymerization is referred to the following literature: (1) Matyjaszewski et al., J. Am. Chem. Soc. 1995, 117, 5614; Macromolecules 1995, 28, 7901; Science 1996, 272, 866; (2) Sawamoto et al., Macromolecules 1995, 28, 1721; WO 96/30421 and WO 97/18247 and JP 2005-240048A.

According to these literature, in general, living radical polymerization is a chain reaction which proceeds at an extremely high rate and can produce a polymer of narrow molecular weight distribution although termination reaction such as coupling of radicals is easily caused. The molecular weight can freely be controlled by varying the reaction ratio of monomer to initiator.

In the present invention, a resin obtained by use of a polymer of the above-described formula (1) is also preferably used as a fixing aid, other than its use as a binder resin.

Next, there will be described a binder resin constituting a toner relating to the present invention.

As described earlier, a binder resin constituting the toner relating to the invention contains a resin formed by using a polymer represented by the formula (1). The binder resin exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2. It was found that when a binder resin of the toner exhibits Mn and Mw meeting the foregoing relationship, enhanced low temperature fixability and improved offset resistance were achieved. It is assumed that a binder resin meeting the foregoing relationship results in enhanced fluidity at a relatively low melt viscosity. The reason therefor is not be clearly understood but, as described earlier, it is assumed that when the molecular weight distribution is close to mono-dispersion, irregular entanglement of molecular chains does not easily occur and rupture of molecular chains, caused by entanglement at the position in which molecular chains are strongly entangled, does not easily occur, resulting in no generation of radicals due to molecular chain rupture, promoting stabilization of the resin. Specifically, in a powdered toner prepared via a process of kneading and grinding, stress is often applied to molecular chains during the course of such preparation. It is thought that even when stress is applied in the process of preparation, rupture of molecular chains does not occur in the present invention.

The number average molecular weight (Mn) and the weight average molecular weight (Mw) of binder resin of a polymer which forms the binder resin or a polymer represented by the formula (1), can be determined by a commonly known method for measuring a molecular weight. In the following, there will be described, as a typical example of molecular weight determination, the procedure for gel permeation chromatography (also denoted as GPC) using a column solvent of tetrahydrofuran (THF).

Specifically, 1 ml of THF (which was previously degassed) was added to 1 mg of a measured sample and completely dissolved with stirring with a magnetic stirrer under room temperature. Subsequently, after filtering with a membrane filter of a 0.45-0.50 μm pore size, a sample solution was poured into a GPC apparatus.

Recommended GPC measurement conditions are as follows: a column is stabilized at 40° C., THF is allowed to flow at a rate of 1 ml/min and 100 μl of a 1 mg/ml concentration sample is poured to be measured. Combined use of commercially available polystyrene gel columns is preferable. Examples thereof include combination of Shodex GPC KF-801, 802, 803, 804, 805, 806 and 807 (produced by Showa Denko Co., Ltd.) and TSKgel G1000H, G2000H, G3000H, G4000H, G5000H, G6000H, G7000H, and TSK guard column (produced by TOSO Co., Ltd.).

Preferred detectors include, for example, a refractive index detector (RI detector) and a UV detector. In molecular weight determination of a sample, the molecular weight distribution of a sample is calculated based on a calibration curve prepared by using monodisperse polystyrene standard particles. It is preferred to use 10 points as polystyrene used to prepare a calibration curve.

In the present invention, determination of molecular weight was conducted under the following conditions.

Measurement Conditions:

Apparatus: HLC-8020 (produced by TOSO Co., Ltd.)
Column: GMHXLLx2, G2000HXLx1
Detector: at least either RI or UV
Flow Rate of Dissolution Liquid: 1.0 ml/min
Sample Concentration: 0.01/20 ml
Sample Volume: 100 μl
Calibration Curve: prepared via standard polystyrene As described earlier, a binder resin constituting the toner relating to the invention contains a resin formed by using a polymer represented by the formula (1). Such a resin formed by using a polymer represented by the formula (1) is incorporated preferably in an amount of 0.5 to 20% by mass of a binder resin, and more preferably 0.5 to 15% by mass.

In the following, there will be described incorporation of a polymer of the formula (1), "both end (meth)acryloyl telechelic polymer" to a binder resin.

When a polymer of the formula (1) is mixed with polymerizable monomers and dissolved in an aqueous surfactant solution to perform polymerization reaction, it is often in such a state that a polymerizable monomer containing the polymer is difficult to molecularly diffuse to surfactant micelles in an aqueous phase and is also difficult to copolymerize with other monomer.

To allow polymerizable monomers including the foregoing polymer to smoothly react, for example, mini-emulsion polymerization, seed polymerization or the two-step swelling method is applicable for preparation of a binder resin containing the polymer of the formula (1), as described below.

(1) Incorporation by Mini-Emulsion Polymerization:

Firstly, a polymer of the formula (1) is mixed with polymerizable monomers and dissolved, then, the polymerizable monomers dissolved in the polymer are added to a surfactant solution, which is subjected to an emulsion micro-dispersion treatment to obtain a micro-dispersed emulsion. Subsequently, a radical-polymerization initiator is added thereto at a prescribed temperature. Thus, binder resin particles containing the polymer of the formula (1) can be prepared according to the foregoing procedure.

In this method, a wax or the like may be dissolved in a monomer solution containing a polymer of the formula (1) and the monomer solution containing a wax or the like is subjected to an emulsion micro-dispersion treatment to perform polymerization. Further, to control molecular weight or molecular weight distribution, glass transition temperature or softening point, binder resin particles prepared by the mini-emulsion polymerization method are used as core particles, and a radical polymerizable monomer is dropwise added thereto to perform seed polymerization to form binder resin particles of a core/shell structure.

(2) Incorporation by Seed Polymerization:

A polymer of the formula (1) is added to a surfactant solution optionally with being heated and is then subjected to an emulsion micro-dispersion treatment by using physical means such as high-speed stirring or ultrasonic exposure. The thus prepared polymer particles were used as core particles and a polymerizable monomer is dropwise added thereto, followed by addition of a radical polymerization initiator to perform seed polymerization on the particle surface of the polymer of the formula (1). Thus, a resin is formed around the polymer of the formula (1) to obtain a binder resin containing the polymer. Alternatively, a mixture of a polymer of the formula (1) and a wax is subjected to an emulsion micro-dispersion treatment, and the thus obtained particles, as core particles, are further subjected to seed polymerization to form binder resin particles containing the polymer.

(3) Incorporation by Two-Step Swelling:

To resin particles prepared by emulsion polymerization of a polymerizable monomer are added a swelling aid, a polymerizable monomer and a polymer of the formula (1), which are absorbed into the resin particles. Then, polymerization is performed to introduce the polymer of the formula (1) into binder resin particles.

According to the foregoing methods, incorporation of a polymer of the formula (1) to a binder resin is feasible. Of the foregoing methods is specifically preferred incorporation via the mini-emulsion polymerization.

There will be described a production method of a toner relating to the present invention. The toner relating to the present invention comprises at least a binder resin formed by use of a polymer represented by the formula (1) and a colorant, which is prepared specifically by a method, called emulsion association process. The emulsion association method for preparation of a toner relating to the present invention is a process in which resin particles are prepared by emulsion polymerization, followed by coagulation and fusion of the resin particles to form toner particles.

A preparation method of a toner by a polymerization process, as represented by an emulsion association method is preferred, in which uniform particle size distribution or shape distribution, or sharp electrostatic charge distribution is readily achieved. Specifically, the toner relating to the present invention achieves fixation of a toner image at a lower temperature relative to the prior art and the fixed toner image is thermally stable and exhibits superior offset resistance. When designating a toner capable of achieving both performances of low temperature fixing and offset resistance, a function-separated type toner of a core/shell structure is preferred, while a preparation method of a toner by a polymerization process is preferred for preparation of such a function-separated toner.

In the preparation method of a toner by a polymerization process, toner particles are prepared via a process of forming resin particles through polymerization reaction such as suspension polymerization or emulsion polymerization. In the present invention, a toner containing a resin formed by using a polymer represented by the afore-described formula (1) is prepared, and, for example, in cases when preparing resin particles by emulsion polymerization, the polymer of the formula (1) is added according to the manner described earlier, whereby resin particles containing a resin formed by use of the polymer of the formula (1) are prepare.

There will be described a preparation method of a toner by a process of emulsion association, as a toner preparation method relating to the invention. Preparation of a toner by a process of emulsion association is conducted through the following steps:

(1) Preparation of resin particle dispersion
(2) Preparation of colorant particle dispersion
(3) Coagulation/fusion of resin particle
(4) Ripening
(5) Cooling
(6) Washing
(7) Drying
(8) External additive treatment In the following, there will be detailed the respective steps.

(1) Preparation of Resin Particle Dispersion:

In this step (1), at least a styrene monomer and a (meth) acryl monomer, as polymerizable monomers to form resin particles are fed into an aqueous medium and dispersed, and allowed to polymerize in the presence of a polymer represented by the formula (1) to form resin particles of an approximately 100 nm size. In the present invention, resin particles, formed by allowing a resin formed by using a polymer of the formula (1) to be contained are prepared in this step. Examples of a preparation method of resin particles containing a resin formed by using a polymer of the formula (1) include a mini-emulsion polymerization method, a seed polymerization method and a two-step swelling method, as described earlier.

The expression "aqueous medium" refers to a medium which is composed of 50-100% by mass of water and 0-50% by mass of a water-soluble organic solvent. Examples of such a water-soluble organic solvent include methanol, ethanol, isopropanol, butanol, acetone and methyl ethyl ketone.

(2) Preparation of Colorant Particle Dispersion:

In this step (2), a colorant is dispersed in an aqueous medium to prepare a colorant particle dispersion in accordance with the procedure, as described earlier. Specifically, in the present invention, a colorant particle dispersion is prepared by using a particulate colorant having a number average primary particle size of 30 to 200 nm, When preparing a toner by using such a colorant particle dispersion, the number average particle size of a colorant within toner particles is 1.1 to 2.5 times the number average primary particle size.

(3) Coagulation/Fusion of Resin Particle:

In this step (3), resin particles and colorant particles are allowed to coagulate in an aqueous medium to form particles and the thus formed particles by coagulation are allowed to fuse and coalesce to prepare parent particles of a toner which are prior to being subjected to an external additive treatment (hereinafter, also denoted as colorant particles). Thus, this step (3) is a step of allowing resin particles to coagulate.

In this step, a coagulant of an alkali metal salt or an alkaline earth metal salt such as magnesium chloride is added to an aqueous medium containing resin particles and colorant particles to coagulate these particles. Subsequently, the aqueous medium is heated at a temperature higher than the glass transition temperature of the resin particles and than the melting peak temperature of the mixture to allow coagulation to proceed and to allow coagulated resin particles to fuse and coalesce. When allowing coagulation to proceed and reaching the targeted particle size, a salt such as sodium chloride or the like is added to stop coagulation, whereby the targeted colored particles are formed.

In this step, resin particles containing a polymer of the formula (1), which were prepared in the foregoing step (1) of preparing a resin particle dispersion, are used to prepare colored particles, as parent particles of a toner relating to the present invention. Alternatively, a particle dispersion of a mixture of a hydroxyl group-containing carboxylic acid ester wax and an aliphatic alcohol is prepared in a manner similar to the foregoing preparation of a colorant particle dispersion and the thus prepared mixture of particles is allowed to coagulate and fuse together with resin particles and colorant particles to prepare colored particles.

In preparation of a toner of core/shell structure, first, resin particles for a core and colorant particles are allowed to coagulate and fuse to form core particles and subsequently, resin particles to form a shell are fed thereto to be allowed to coagulate and fuse onto the core particle surface. Thus, the coagulation/fusion step is conducted two-stepwise to prepare colored particles of core/shell structure.

(4) Ripening:

Subsequent to the foregoing coagulation/fusion step, the reaction system is subjected to a heat treatment to ripen colored particles until the colored particles reach the targeted average circularity. This ripening step is also called the shape controlling step. In the ripening step, colored particles, formed in the coagulation/fusion step, are heated to a temperature higher than the glass transition temperature of the binder resin constituting colored particles to perform shape control of the colored particles.

(5) Cooling:

In this cooling step, a dispersion of colored particles is subjected to a cooling treatment (rapid cooling treatment). A cooling treatment is conducted at a cooling rate of 1 to 20° C./min. A cooling treatment is not specifically limited and examples thereof include a method in which a cooling medium is introduced from the outside of a reactor and a method in which a cooling water is fed directly to the reaction system.

(6) Washing:

This washing step comprises a solid/liquid separation step of separating colored particles from a colored particle dispersion which was cooled to a prescribed temperature in the foregoing step and a subsequent washing step to remove any attached surfactant, coagulant or the like from the wetted surface of separated color particles.

In the manufacturing process, colored particles, which were separated via solid/liquid separation, are usually in the form of a cake-like aggregate which is called a toner cake. Such a toner cake is disintegrated before washing. Washing is conducted with water until the electric conductivity of the filtrate reaches a level of 10 μS/cm. Examples of methods for a solid/liquid separation include a centrifugal separation method, a reduced-pressure filtration method using a Nutsche funnel and a filtration method using a filter press.

(7) Drying:

In this drying step, washed colored-particles are dried to obtain dried colored-particles. Examples of a dryer usable in this step include a spray dryer, a vacuum freeze-dryer and a reduced-pressure dryer. However, it is preferred to use a standing plate dryer, a mobile plate dryer, a fluidized-bed dryer, a rotary dryer or a stirring dryer.

The moisture content of dried colored-particles is preferably not more than 5% by mass, and more preferably not more than 2% by mass. In cases when dried colored-particles are aggregated by a weak attractive force between particles to form an aggregate, such an aggregate may be subjected to a disintegration treatment. There are usable mechanical disintegrators such as a jet mill, a HENSCHEL MIXER, a coffee mill or a food processor.

(8) External Additive Treatment:

In this external additive treatment step, external additives or a lubricant is added to dried colored-particles to prepare toner particles usable for image formation. Colored particles which were subjected to the drying step may be used as toner particles, but addition of external additives can enhance the electrostatic-charging property, fluidity and cleaning property. External additives usable in the present invention include, for example, organic or inorganic particles and aliphatic metal salts. An external additive is added preferably in an amount of 0.1 to 10.0% by mass, and more preferably 0.5 to 4.0%, by mass. A variety of additives may be combined. Examples of a mixing device, used to add external additives include a turbuler mixer, a HENSCHEL MIXER, a Nautor Mixer, a V-type mixer and a coffee mill.

A toner comprising a binder resin containing a resin formed by using a polymer of the formula (1) can be prepared via the above-described steps, in which the binder resin exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2. There will be described later a polymerization initiator, a dispersion stabilizer and a surfactant which are usable in preparation of a toner relating to the present invention by a process of emulsion association, as described above.

The present invention is directed to preparation of a toner capable of achieving enhanced low-temperature fixability and improved offset resistance by a process of emulsion association, in which a binder resin constituting a toner preferably exhibits a glass transition temperature of 60 to 70° C. The glass transition temperature of a binder resin can be determined by using, for example, a DSC-7 differential scanning calorimeter (produced by Perkin Elmer Corp.) or a TAC7/DX thermal analysis controller (produced by Perkin Elmer Corp.). The measurement is conducted as follows. A toner of 4.5-5.0 mg is precisely weighed to two places of decimals, sealed into an aluminum pan (KIT NO. 0219-0041) and set into a DSC-7 sample holder. An empty aluminum pan is used as a reference. Temperature was controlled through heating-cooling-heating at a temperature-raising rate of 10° C./min and a temperature-lowering rate of 10° C./min in the range of 0 to 200° C.

An extension line from the base-line prior to the initial rise of the first endothermic peak and a tangent line exhibiting the maximum slope between the initial rise and the peak are drawn and the intersection of both lines is defined as the glass transition point.

There will be described a binder resin and wax constituting the toner relating to the present invention, with reference to specific examples.

In the toner relating to the present invention, a binder resin contains a resin, which is formed by use of "both end (meth) acryloyl telechelic polymer" represented by the formula (1) and is also formed by performing polymerization using at least a styrene monomer and an acryloyl monomer. The toner can also employ a binder resin using the foregoing resin in combination with commonly known a polymer resin such as a vinyl polymer. In the binder resin constituting the toner relating to the invention, a polymer which is usable in combination with a resin formed by use of "both end (meth) acryloyl telechelic polymer" includes, for example, a polymer prepared by use of vinyl monomers singly or in combination.

Specific examples of a polymerizable vinyl monomer are described below. Styrene monomers used to form a resin by using a polymer of the formula (1) include styrene and its derivatives, as shown below. Further, (meth)acryl monomers include not only an acrylic acid monomer and a methacrylic acid monomer but also acrylic acid ester derivatives and methacrylic acid ester derivatives, as shown below:

(1) Styrene and Styrene Derivative:

styrene, o-methylstyrene, m-methylstyrene, p-methylstyrene, α-m methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene;

(2) Methacryl Acid Ester Derivative:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate;

(3) Acrylic Acid Ester Derivative:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate;

(4) Olefins:

ethylene, propylene, isobutylene;

(5) Vinyl Esters:

vinyl propionate, vinyl acetate, vinyl benzoate;

(6) Vinyl Ethers:

vinyl methyl ether, vinyl ethyl ether;

(7) Vinyl Ketones:

vinyl methyl ketone, vinyl ethyl ketone, vinyl hexyl ketone;

(8) N-Vinyl Compounds:

N-vinylcarbazole, N-vinylindole, N-vinylpyrrolidone;

(9) Others:

vinyl compounds such as vinylnaphthalene, vinylpyridine; acrylic acid or methacrylic acid derivatives such as acrylonitrile, methacrylonitrile and acrylamide.

Polymerizable vinyl monomers forming a resin usable in the toner relating to the present invention can also employ one containing an ionic dissociative group such as a carboxyl group, a sulfonic acid group or a phosphoric acid group.

Examples of such one containing a carboxyl group include acrylic acid, methacrylic acid, maleic acid, itaconic acid, cinnamic acid, fumaric acid, maleic acid monoalkyl ester and itaconic acid monoalkyl ester. Examples of such one containing a sulfonic acid group include styrene sulfonic acid, allylsulfosuccinic acid, and 2-acrylamido-2-methylpropane sulfonic acid. Examples of such one containing a phosphoric acid group include acidophosphooxyethyl methacrylate.

A resin of a crosslinking structure can also prepare by using poly-functional vinyl compounds. Examples thereof are as below:

ethylene glycol dimethacrylate, ethylene glycol diacrylate, diethylene glycol dimethacrylate, diethylene glycol diacrylate, triethylene glycol dimethacrylate, triethylene glycol diacrylate, neopentylene glycol dimethacrylate, and neopentylene glycol diacrylate.

Colorants usable in the toner relating to the present invention include those known in the art and specific examples thereof are as follows:

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 163, C.I. Pigment Red 166, C.I. Pigment Red 170, C.I. Pigment Red 177, C.I. Pigment Red 178, C.I. Pigment Red 184, C.I. Pigment Red 202, C.I. Pigment Red 206, C.I. Pigment Red 207, C.I. Pigment Red 209, C.I. Pigment Red 222, C.I. Pigment Red 238 and C.I. Pigment Red 269.

Orange or yellow colorants include C.I. Pigment Orange 31, C.I. Pigment Orange 43, C.I. Pigment Yellow 12, C.I. Pigment Yellow 14, C.I. Pigment Yellow 15, C.I. Pigment Yellow 17, C.I. Pigment Yellow 74, C.I. Pigment Yellow 83, C.I. Pigment Yellow 93, C.I. Pigment Yellow 94, C.I., Pigment Yellow 138, C.I. Pigment Yellow 155, C.I. Pigment Yellow 162, C.I. Pigment Yellow 180 and C.I. Pigment Yellow 185.

Green or cyan colorants include C.I. Pigment Blue 2, C.I. Pigment Blue 3, C.I. Pigment Blue 15, C.I. Pigment Blue 15:2, C.I. Pigment Blue 15:3, C.I. Pigment Blue 15:4, C.I. Pigment Blue 16, C.I. Pigment Blue 17, C.I. Pigment Blue 60, C.I. Pigment Blue 62, C.I. Pigment Blue 66 and C.I. Pigment Green 7.

Dyes include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 2, C.I. Solvent Yellow 6, C.I. Solvent Yellow 14, C.I. Solvent Yellow 15, C.I. Solvent Yellow 16, C.I. Solvent Yellow 19, C.I. Solvent Yellow 21, C.I. Solvent Yellow 33, C.I. Solvent Yellow 44, C.I. Solvent Yellow 56, C.I. Solvent Yellow 61, C.I. Solvent Yellow 77, C.I. Solvent Yellow 79, C.I. Solvent Yellow 80, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93 and C.I. Solvent Blue 95.

The foregoing colorants may be used alone or in combination. The colorant content is preferably from 1% to 30% by mass, and more preferably 2% to 20% by mass of the whole of a toner. A number average primary particle size, depending of its kind, is approximately from 10 to 200 nm.

A colorant is added, for example, at the time when resin particles are coagulated by a coagulant to color a polymer. The colorant particle surface may be treated by a coupling agent or the like.

There will be described wax usable for the toner relating to the invention. Waxes usable in the toner of the present invention are those known in the art. Examples thereof include (1) polyolefin wax such as polyethylene wax and polypropylene wax; (2) long chain hydrocarbon wax such as paraffin wax and sasol wax; (3) dialkylketone type wax such as distearylketone; (4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl maleate; (5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

A resin formed by use of a polymer of the formula (1) may be employed not only for a binder resin but also as a fixing aid. It is assumed that the resin formed by use of a polymer of the formula (1) promotes releasing capability of the foregoing wax in fixing by the action of flexibility of the polymer of the formula (1), leading to enhanced fixability at a relatively low temperature.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-805, R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SS, JA-1 which are commercially available from Teika Co.; TA-300SI, TA-500, TAF-130, TAF-510 and TAF-510T which as commercially available from Fuji Titan Co., Ltd.; IT-S, IT-QA, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

Spherical organic microparticles having a number-average primary particle size of 10 to 2000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL MIXER, a Nauter mixer or a V-shape mixer.

There will be described a polymerization initiator, a dispersion stabilizer and a surfactant usable in preparation of the toner relating to the invention by a process of emulsion association.

There are usable commonly known oil-soluble or water-soluble polymerization initiators when forming a binder resin of the toner relating to the present invention.

Examples of an oil-soluble polymerization initiator include azo- or diazo-type polymerization initiators. Specific examples thereof include (1) azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; and (2) peroxide type polymerization initiators, e.g., benzoyl peroxide, methyl ethyl ketone peroxide, diisopropylperoxycarbonate, cumene hydroperoxide, t-butyl hydroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine.

Water-soluble radical polymerization initiators are usable when forming particulate resin through emulsion polymerization. Examples of a water-soluble polymerization initiator include persulfates such as potassium persulfate and ammonium persulfate; azobisaminodipropane acetic acid salt, azobiscyanovaleric acid and its salt, and hydrogen peroxide.

Conventionally used chain-transfer agents are usable for the purpose of adjustment of the molecular weight of resin constituting composite resin particles. Chain-transfer agents are not specifically limited and examples thereof include mercaptans such as octylmercaptan, dodecylmercaptan and tert-dodecylmercaptan; n-octyl-3-mercaptopropionic acid ester; terpinolene; carbon tetrabromide and α-methylstyrene dimmer.

In the present invention, a tone is prepared in such a manner that polymerizable monomers which are dispersed in an aqueous medium are allows to polymerize, or resin particles which are dispersed in an aqueous medium are allowed to coagulate and fuse. Accordingly, it is preferred to use a dispersion stabilizer to allow these material to be stably dispersed in the aqueous medium. Examples of a dispersion stabilizer include calcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Further, polyvinyl alcohol, gelatin, methylcellulose, sodium dodecybenzenesulfate, ethylene oxide adduct, sodium higher alcohol-sulfate and the like, which are generally usable as a surfactant, are also usable as a dispersion stabilizer.

To perform polymerization of polymerizable monomers in an aqueous medium, surfactants are used to disperse such monomers in the form of oil droplets in an aqueous medium. Surfactants usable therein are not specifically limited but ionic surfactants described below are preferred. Such ionic surfactants include, for example, sulfonates, sulfuric acid ester salts and carboxylic acid salts. Examples of sulfonates include sodium dodecylbenzenesulfate, sodium arylalkylpolyethersulfonate, sodium 3,3-disulfondisphenylurea-4,4-diazo-bis-amino-8-naphthol-6-sulfonate, ortho-carboxybenzene-azo-dimethylaniline, sodium 2,2,5,5-tetramethyltriphenylmethane-4,4-diazo-bis-β-naphthol-6-sulfonate.

Examples of a sulfuric acid ester salt include sodium dodecylsulfonate, sodium tetradecylsulfonate, sodium pentadecylsulfonate, and sodium octylsulfonate. Specific examples of a carboxylate include carboxylates sodium oleate, sodium laurate, sodium caprate, sodium caprylate, sodium caproate, potassium stearate and calcium oleate.

Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester.

Next, there will be described a developer employing the toner relating to the present invention. A toner relating to the present invention is used as a dry-process toner, and the toner is usable as a two-component developer comprised of a carrier and a toner, or a single-component developer comprised of a toner alone.

The use of the toner of the present invention as a two-component developer enables full-color printing by using a tandem system image forming apparatus, as described later. Magnetic particles used as a carrier of a two-component developer can use commonly known materials, e.g., metals such as iron, ferrite and magnetite and alloys of the foregoing metals and metals such as aluminum or lead. Of these, ferrite particles are preferred.

A volume-based average particle size of a carrier is preferably from 15 to 100 μm, and more preferably 25 to 80 μm. A magnetic saturation susceptibility is preferably from 20 to 80 emu/g. The use of a carrier exhibiting such a particle size and a magnetic saturation susceptibility enables to form a soft magnetic brush on a development sleeve at the time of development, leading to formation of a toner image exhibiting superior sharpness. The above-described volume-based average particle size and magnetic saturation susceptibility can be determined by a measurement instrument known in the art. Specifically, the volume-based average particle size can be measured by laser diffraction sensor HELOS (produced by SYMPATECS Co., Ltd.) which is installed with a wet disperser, and the saturation susceptibility can be measured by, for example, direct current susceptibility automatic recorder 3257-35 (produced by Yokokawa Denko. Co., Ltd.).

A two-component developer is obtained by mixing a toner and a carrier according to the method known in the art. A toner content is preferably 2 to 10 by mass, based on carrier. A mixer usable in the present invention is not specifically limited, including, for example, a Nauter mixer and a W-cone or V-shape mixer.

When used as a nonmagnetic single-component developer without a carrier to perform image formation, a toner is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

In the following, there will be described an image forming method enabling to use the toner relating to the present invention. The image forming method relating to the invention employs a toner comprising a binder resin and a colorant, in which the binder resin contains a resin formed by using a polymer represented by the afore-described formula (1) and exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2, and forms a toner image on a transfer paper to make a print via the following steps: (1) a latent image forming step of forming a latent image on the surface of an electrophotographic photoreceptor, (2) development step of developing the electrophotographic latent image formed on the surface of an electrophotographic photoreceptor to form a toner image, (3) transfer step of transferring the toner image onto the surface of a transfer material, and (4) fixing step of thermally fixing the toner image transferred onto the transfer material.

FIG. 1 illustrates an example of an image forming apparatus to perform a monochromatic type image formation by using a toner relating to the present invention.

An image forming apparatus 1, as illustrated in FIG. 1, is a digital type image forming apparatus, which comprises an image reading section A, an image processing section B, an image forming section C and a transfer paper conveyance section D as a means for conveying transfer paper.

An automatic manuscript feeder to automatically convey a manuscript is provided above the image reading section. A manuscript placed on a manuscript-setting table 11 is conveyed sheet by sheet by a manuscript-conveying roller 12 and read at a reading position 13*a* to read images. A manuscript having finished manuscript reading is discharged onto a manuscript discharge tray 14 by the manuscript-conveying roller 12.

On the other hand, the image of a manuscript placed on a platen glass 13 is read by a reading action, at a rate of v, of a first mirror unit 15 constituted of a lighting lamp and a first mirror, followed by conveyance at a rate of v/2 toward a second mirror unit 16 constituted of a second mirror and a third mirror which are disposed in a V-form.

The thus read image is formed through a projection lens 17 onto the acceptance surface of an image sensor CCD as a line sensor. Aligned optical images formed on the image sensor CCD are sequentially photo-electrically converted to electric signals (luminance signals), then subjected A/D conversion and further subjected to treatments such as density conversion and a filtering treatment in the image processing section B, thereafter, the image data is temporarily stored in memory.

In the image forming section C is provided a drum-form photoreceptor 1 as an image bearing body and in its surrounding, a charger 2, a potential sensor 220 to detect the surface potential of the charged photoreceptor, a developing device 4, a transfer means 5, a cleaning device 6 (cleaning step) for the photoreceptor 21 and a pre-charge lamp (PCL) 8 as a photo-neutralizer (photo-neutralizing step) are disposed in the order to carry out the respective operations. A reflection density detector 222 to measure the reflection density of a patch image developed on the photoreceptor 1 is provided downstream from the developing means 4. The photoreceptor 1 is rotatably driven clockwise, as indicated.

After having been uniformly charged by the charger 2, the photoreceptor 1 is imagewise exposed through an exposure optical system as an imagewise exposure means 3, based on image signals called up from the memory of the image processing section B. The imagewise exposure means 3 exposes the photoreceptor at the position of Ao to form an electrostatic latent image on the surface of the photoreceptor 1.

The electrostatic latent image on the photoreceptor 1 is developed by the developing means 4 to form a toner image on the photoreceptor 1.

In the transfer paper conveyance section D, paper supplying units 41(A), 41(B) and 41(C) as a transfer paper housing means for housing transfer paper P differing in size are provided below the image forming unit and a paper hand-feeding unit 42 is laterally provided, and transfer paper P chosen from either one of them is fed by a guide roller 43 along a conveyance route 40. After the fed paper P is temporarily stopped by paired paper feeding resist rollers 44 to make correction of tilt and bias of the transfer paper P, paper feeding is again started and the paper is guided to the conveyance route 40, a transfer pre-roller 43*a*, a paper feeding route 46 and entrance guide plate 47. A toner image on the photoreceptor 1 is transferred onto the transfer paper P at the position of Bo by a transfer pole 24 and a separation pole 25, while being conveyed with being put on a transfer conveyance belt 454 of a transfer conveyance belt device 45. The transfer paper P is separated from the surface of the photoreceptor 21 and conveyed to a fixing device 50 by the transfer conveyance belt 5.

The fixing device 50 has a fixing roller 51 and a pressure roller 52 and allows the transfer paper P to pass between the fixing roller 51 and the pressure roller 52 to fix the toner by heating and pressure. The transfer paper P which has completed fixing of the toner image is discharged onto a paper discharge tray 64.

Image formation on one side of transfer paper is described above and in the case of two-sided copying, a paper discharge switching member 170 is switched over, and a transfer paper guide section 177 is opened and the transfer paper P is conveyed in the direction of the dashed arrow. Further, the transfer paper P is conveyed downward by a conveyance mechanism 178 and switched back in a transfer paper reverse section 179, and the rear end of the transfer paper P becomes the top portion and is conveyed to the inside of a paper feed unit 130 for two-sided copying. Further, the transfer paper P is conveyed downward by a conveyance mechanism 178 and switched back in a transfer paper reverse section 179, and the rear end of the transfer paper P becomes the top portion and is conveyed to the inside of a paper feed unit 130 for two-sided copying. The transfer paper P is moved along a conveyance guide 131 in the paper feeding direction, transfer paper P is again fed by a paper feed roller 132 and guided into the transfer route 40. According to the foregoing procedure, a toner image can be formed on the back surface of the transfer paper P.

In an image forming apparatus relating to the invention, constituent elements such as a photoreceptor, a developing device and a cleaning device may be integrated as a process cartridge and this unit may be freely detachable. At least one of an electrostatic charger, an image exposure device, a transfer or separation device and a cleaning device is integrated with a photoreceptor to form a process cartridge as a single detachable unit from the apparatus body and may be detachable by using a guide means such as rails in the apparatus body.

Figure 2:
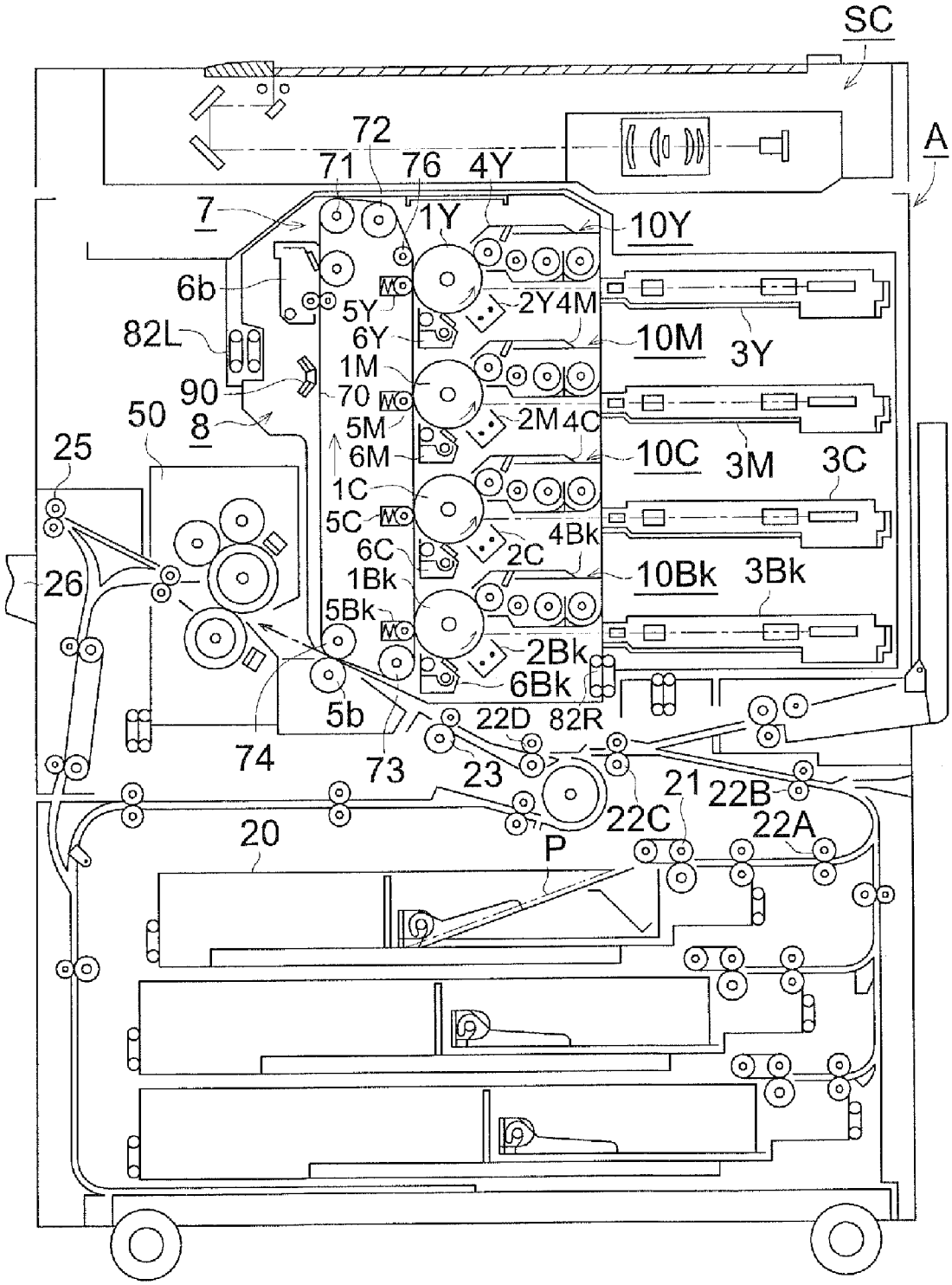
FIG. 2 illustrates an example of a tandem type color image forming apparatus.

FIG. 2 shows a schematic view of a color image forming apparatus showing one of the embodiments of the invention.

In FIG. 2, 1Y, 1M, 1C and 1K are each a photoreceptor; 4Y, 4M, 4C and 4K are each a developing device; 5Y, 5M, 5C and 5K are each primary transfer roll as a primary transfer means; 5A is a secondary transfer roll as a secondary transfer means; 6Y, 6M, 6C and 6K are each a cleaning device; 7 is an intermediate transfer unit, 50 is a heat roll type fixing device, and 70 is an intermediate transfer body unit, 50 is a heat roll type fixing device.

This image forming apparatus is called a tandem color image forming apparatus, which is, as a main constitution, comprised of plural image forming sections 10Y, 10M, 10C and 10Bk; an intermediate transfer material unit 7 of an endless belt form, a paper feeding and conveying means 21 to convey a recording member P and a heat-roll type fixing device 50 as a fixing means. Original image reading device SC is disposed in the upper section of an image forming apparatus body A.

As one of different color toner images of the respective photoreceptors, image forming section 10Y to form a yellow image comprises a drum-form photoreceptor 1Y as the first photoreceptor; an electrostatic-charging means 2Y, an exposure means 3Y, a developing means 4Y, a primary transfer roller 5Y as a primary transfer means; and a cleaning means 6Y, which are disposed around the photoreceptor 1Y.

As another one of different color toner images of the respective photoreceptors, image forming section 10M to form a magenta image comprises a drum-form photoreceptor 1M as the first photoreceptor; an electrostatic-charging means 2M, an exposure means 3M, a developing means 4M, a primary transfer roller 5M as a primary transfer means; and a cleaning means 6M, which are disposed around the photoreceptor 1M. Further, as one of different color toner images of the respective photoreceptors, image forming section 10C to form a cyan image comprises a drum-form photoreceptor 1C as the first photoreceptor; an electrostatic-charging means 2C, an exposure means 3C, a developing means 4C, a primary transfer roller 5C as a primary transfer means; and a cleaning means 6C, which are disposed around the photoreceptor 1C. Furthermore, as one of different color toner images of the respective photoreceptors, image forming section 10K to form a cyan image comprises a drum-form photoreceptor 1K as the first photoreceptor; an electrostatic-charging means 2K, an exposure means 3K, a developing means 4K, a primary transfer roller 5K as a primary transfer means; and a cleaning means 6K, which are disposed around the photoreceptor 1K.

Intermediate transfer unit 7 of an endless belt form is turned by plural rollers and has intermediate transfer material 70 as the second image carrier of an endless belt form, while being pivotably supported.

The individual color images formed in image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image. Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on the recording member P. The color image-transferred recording member (P) is fixed by a heat-roll type fixing device 24, nipped by a paper discharge roller 25 and put onto a paper discharge tray outside a machine.

After a color image is transferred onto the recording member P by a secondary transfer roller 5*b* as a secondary transfer means, an intermediate transfer material 70 of an endless belt form which separated the recording material P removes any residual toner by cleaning means 6*b*.

During the image forming process, the primary transfer roller 53*k* is always in contact with the photoreceptor 13*k*. Other primary transfer rollers 5Y, 5M and 5C are each in contact with the respectively corresponding photoreceptors 1Y, 1M and 1C only when forming a color image.

The secondary transfer roller 5*b* is in contact with the intermediate transfer material 70 of an endless belt form only when the recording member P passes through to perform secondary transfer.

A housing 8, which can be pulled out from the apparatus body A through supporting rails 82L and 82R, is comprised of image forming sections 10Y, 10M, 10C and 10Bk and the endless belt intermediate transfer unit 7.

Image forming sections 10Y, 10M, 10C and 10Bk are aligned vertically. The endless belt intermediate transfer material unit 7 is disposed on the left side of photoreceptors 1Y, 1M, 1C and 1Bk, as indicated in FIG. 2. The intermediate transfer material unit 7 comprises the endless belt intermediate transfer material 70 which can be turned via rollers 71, 72, 73 and 74, primary transfer rollers 5Y, 5M, 5C and 5Bk and cleaning means 6*b*.

Thus, toner images are formed on the photoreceptors 1Y, 1M, 1C and 1K via charging, exposure and development, toner images of the respective colors are superimposed on the endless belt intermediate transfer material 70, transferred together to the recording member P and fixed by applying pressure with heating in the fixing device 50. After having transferred the toner image onto the recording member P, the photoreceptor 1Y, 1M, 1C and 1K are each cleaned in a cleaning device to remove a remained toner and enter the next cycle of charging, exposure, and development to perform image formation.

Figure 3:
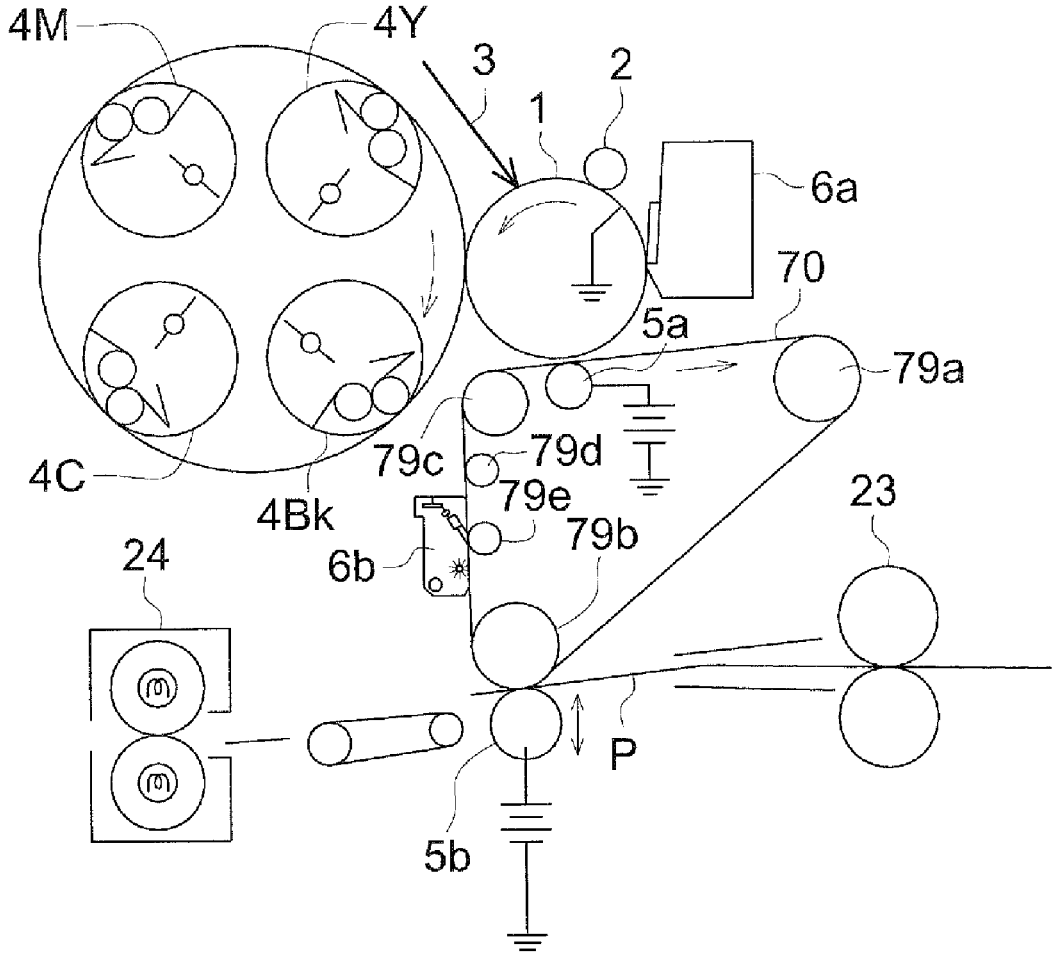
FIG. 3 illustrates an other example of a color image forming apparatus.

FIG. 3 also shows a schematic sectional view of a color image forming apparatus differing from the image forming apparatus shown in FIG. 2. The image forming apparatus of FIG. 3 comprises, around an organic photoreceptor, an electrostatic-charging means, an exposure means, plural developing means, a transfer means, a cleaning means and an intermediate transfer means. The intermediate transfer material 70 of an endless belt form employs an elastomer of moderate resistance.

The numeral 1 designates a rotary drum type photoreceptor, which is repeatedly used as an image forming body, is rotatably driven anticlockwise, as indicated by the arrow, at a moderate circumferential speed. The photoreceptor 1 is uniformly subjected to an electrostatic-charging treatment at a prescribed polarity and potential by a charging means 2, while being rotated. Subsequently, the photoreceptor 1 is subjected to imagewise exposure via an imagewise exposure means 3 to form an electrostatic latent image corresponding to a yellow (Y) component image (color data) of the objective color image.

Subsequently, the electrostatic latent image is developed by a yellow toner of a first color in a yellow (Y) developing means 4Y: developing step (the yellow developing device). At that time, the individual developing devices of the second to fourth developing means 4M, 4C and 4Bk (magenta developing device, cyan developing device, black developing device) are in operation-off and do not act onto the photoreceptor 1 and the yellow toner image of the first color is not affected by the second to fourth developing devices.

The intermediate transfer material 70 is rotatably driven clockwise at the same circumferential speed as the photoreceptor 1, while being tightly tensioned onto rollers 79*a*, 79*b*, 79*c*, 79*d* and 79*e*.

The yellow toner image formed and borne on the photoreceptor 1 is successively transferred (primary-transferred) onto the outer circumferential surface of the intermediate transfer material 70 by an electric field formed by a primary transfer bias applied from a primary transfer roller 5*a* to the intermediate transfer material 70 in the course of being passed through the nip between the photoreceptor 1 and the intermediate transfer material 70.

The surface of the photoreceptor 1 which has completed transfer of the yellow toner image of the first color is cleaned by a cleaning device 6*a*.

In the following, a magenta toner image of the second color, a cyan toner image of the third color and a black toner image of the fourth color are successively transferred onto the intermediate transfer material 70 and superimposed to form superimposed color toner images corresponding to the intended color image.

A secondary transfer roller 5*b*, which is allowed to bear parallel to a secondary transfer opposed roller 79*b*, is disposed below the lower surface of the intermediate transfer material 70, while being kept in the state of being separable.

The primary transfer bias for transfer of the first to fourth successive color toner images from the photoreceptor 1 onto the intermediate transfer material 70 is at the reverse polarity of the toner and applied from a bias power source. The applied voltage is, for example, in the range of +100 V to +2 kV.

In the primary transfer step of the first through third toner images from the photoreceptor 1 to the intermediate transfer material 70, the secondary transfer roller 5*b* and the cleaning means 6*b* for the intermediate transfer material are each separable from the intermediate transfer material 70.

The superimposed color toner image which was transferred onto the intermediate transfer material 70 is transferred to a transfer material P as the second image bearing body in the following manner. Concurrently when the secondary transfer roller 5*b* is brought into contact with the belt of the intermediate transfer material 70, the transfer material P is fed at a prescribed timing from paired paper-feeding resist rollers 23, through a transfer paper guide, to the nip in contact with the belt of the intermediate transfer material 70 and the secondary transfer roller 5*b*. A secondary transfer bias is applied to the second transfer roller 5*b* from a bias power source. This secondary bias transfers (secondary-transfers) the superimposed color toner image from the intermediate transfer material 70 to the transfer material P as a secondary transfer material. The transfer material P having the transferred toner image is introduced to a fixing means 24 and is subjected to heat-fixing.

EXAMPLES

The present invention will be further described with reference to examples, but the embodiments of the invention are by no means limited to these. In the following examples, "part(s)" represents part(s) by mass unless otherwise noted.

1. Preparation of Polymers 1-9

Polymers 1-9 represented by the formula (1), that is "both end (meth)acryloyl telechelic polymers 1-9", as shown in Table 1, were each prepared according to the method known in the art. The prepared polymers 1-9, represented by the formula (1) are shown in Table 1, with respect to structural formula, n in the formula, number average molecular weight (Mn), and ratio (Mw/Mn) of weight average molecular weight (Mw) to number average molecular weight (Mn).

TABLE 1

| Polymer No. | Structural Formula | n (Median Value) | Constitution X | Constitution Y | Mn | Mw/Mn |
|---|---|---|---|---|---|---|
| 1 | (1)-1 | 25 | acryloyl group | n-butylacrylate | 3300 | 1.19 |
| 2 | (1)-1 | 40 | acryloyl group | n-butylacrylate | 5000 | 1.17 |
| 3 | (1)-12 | 400 | methacryloyl group | n-butylacrylate | 50000 | 1.13 |
| 4 | (1)-1 | 20 | acryloyl group | n-butylacrylate | 2700 | 1.28 |
| 5 | (1)-23 | 1500 | acryloyl group | propylene | 63000 | 1.10 |
| 6 | (1)-3 | 250 | acryloyl group | styrene | 26000 | 1.01 |
| 7 | (1)-2 | 200 | acryloyl group | styrene/n-butylacrylate | 23000 | 1.15 |
| 8 | (1)-4 | 250 | acryloyl group | styrene/methacrylate | 26000 | 1.17 |
| 9 | (1)-23 | 1000 | methacryloyl group | propylene | 45000 | 1.04 |

2. Preparation of Toners 1-19

2-1. Preparation of Resin Particle 1-19

Resin particles used for core 1-19 (hereinafter, also denoted simply as core resin particles 1-19) were each prepared as below. In the following, the particle size of a resin used for a core is expressed in terms of average particle size, which is equivalent to generally called "volume-based median diameter". The average particle size is determined using MICROTRAC UPA-159 (produced by HONEYWELL Corp.) under the following conditions:

| | |
|---|---|
| Sample refractive index | 1.59 |
| Sample specific gravity | 1.05 (converted to spherical particle) |
| Solvent refractive index | 1.33 |
| Solvent viscosity | 0.797 (30° C.), 1.002 (20° C.) |

Zero-point adjustment was made with adding deionized water into a measurement cell.

The expression "average particle size" described in the preparation of "Colorant particle C", described later is also a volume-based median diameter which is determined using the same instrument as above under the same conditions as above.

(1) Preparation of Core Resin Particle 1

A monomer emulsion comprised of following compounds was prepared according to the procedure, as below.

| | |
|---|---|
| Styrene | 201 parts |
| n-Butyl acrylate | 100 parts |
| Methacrylic acid | 18 parts |
| Polymer 2 | 17 parts |
| Behenyl behenate | 172 parts |

When mixing the foregoing compounds, the polymer 2 and behenyl behenate were dissolved in a mixture of styrene, n-butyl acrylate and methacrylic acid as polymerizable monomers to prepared a mixed solution.

Subsequently, the mixed solution was added to a solution of 11 parts of anionic surfactant, EMAL E27C (produced by KAO Co., Ltd.) dissolved in 1107 parts of pure water, maintained at 80° C. and then was subjected to high-speed stirring in a mechanical disperser provided with a circulation path, CLEARMIX (produced by M-Technique Co., Ltd.) to prepare a monomer emulsion.

Into a reactor equipped with a stirrer, a temperature sensor, a condenser and a nitrogen gas introducing device, a mixture, as described below was added and the internal temperature was raised to 70° C., while stirring under a nitrogen gas stream and the foregoing monomer emulsion was added.

| | |
|---|---|
| Pure water | 1050 parts |
| Resin particle dispersion* | 237 parts |

*average particle size of 130 nm, Mw = 15,000, solids 30%, methyl methacrylate/butyl acrylate/itaconic acid = 78.5/16.5/5 (mass ratio)

A polymerization initiator solution of 10 parts of potassium persulfate (KPS) dissolved in 190 parts of pure water was added to the reactor with stirring, while maintaining the internal temperature of the reactor at 70° C., and after dropwise adding 5 parts of n-octylmercaptan over 5 min., polymerization was performed at the same temperature over 40 min.

Subsequently, into the reactor was added a polymerization initiator solution of 10 parts of potassium persulfate (KPS) dissolved in 190 parts of pure water, and a monomer solution, as described below was dropwise added thereto over 1 hr. and polymerization was performed over 1 hr.

| | |
|---|---|
| Styrene | 366 parts |
| n-Butyl acrylate | 179 parts |
| n-Octylmercaptan | 9 parts |

Thereafter, the reaction mixture was cooled to room temperature to obtain "core resin particle 1". The thus obtained "core resin particle 1", which was formed by use of the polymer 2 of both end (meth)acryloyl telechelic polymer, exhibited an average particle size of 210 nm and a number average molecular weight of 18,000.

(2) Preparation of Core Resin Particle 2

A dispersion of core resin particle 2 was prepared in the same manner as the foregoing core resin particle 1, except that an addition amount of n-butyl acrylate used for preparation of a monomer emulsion was varied to 84 parts, an addition amount of polymer 2 was varied to 34 parts, and the polymerization initiator solution was replaced by a solution of 11.5 parts of potassium persulfate dissolved in 220 parts. The thus prepared core resin particle 2, which was formed by use of the polymer 2 of both end (meth)acryloyl telechelic polymer, exhibited an average particle size of 220 nm and a number average molecular weight of 19,500.

(3) Preparation of Core Resin Particle 3

A dispersion of core resin particle 3 was prepared in the same manner as the foregoing core resin particle 1, except that the polymer 2 was replaced by polymer G. The thus prepared core resin particle 3, which was formed by use of the polymer 6 of both end (meth)acryloyl telechelic polymer, exhibited an average particle size of 200 nm and a number average molecular weight of 22,400.

(4) Preparation of Core Resin Particle 4

A dispersion of core resin particle 4 was prepared in the same manner as the foregoing core resin particle 3, except that the amount of n-butylacrylate used for preparation of a monomer emulsion was varied to 110 parts by mass and the amount of the polymer 6 was varied to 8 parts by mass. The thus prepared core resin particle 4, which was formed by use of the polymer 6 of both end (meth)acryloyl telechelic polymer, exhibited an average particle size of 205 nm and a number average molecular weight of 23,200.

(5) Preparation of Core Resin Particle 5

A dispersion of core resin particle 5 was prepared in the same manner as the foregoing core resin particle 4, except that the amount of n-butylacrylate used for preparation of a monomer emulsion was varied to 115 parts by mass and the amount of the polymer 6 was varied to 2 parts by mass. The thus prepared core resin particle 5, which was formed by use of the polymer 6 of both end (meth)acryloyl telechelic polymer, exhibited an average particle size of 215 nm and a number average molecular weight of 23,900.

(6) Preparation of Core Resin Particle 6

A dispersion of core resin particle 6 was prepared in the same manner as the foregoing core resin particle 1, except that the polymer 2 was replaced by polymer 7. The thus prepared core resin particle 6, which was formed by use of the polymer 7 of both end (meth)acryloyl telechelic polymer, exhibited an average particle size of 230 nm and a number average molecular weight of 28,500.

(7) Preparation of Core Resin Particle 7

A dispersion of core resin particle 7 was prepared in the same manner as the foregoing core resin particle 1, except that the polymer 2 was replaced by polymer 8. The thus prepared core resin particle 7, which was formed by use of the polymer 8 of both end (meth)acryloyl telechelic polymer, exhibited an average particle size of 240 nm and a number average molecular weight of 25,300.

(8) Preparation of Core Resin Particle 8

In a reactor equipped with a stirrer, a temperature sensor, a condenser and a nitrogen gas introducing device, 11 parts of anionic surfactant, EMAL E27C (produced by KAO Co., Ltd.) was dissolved in 950 parts of pure water and the temperature was raised to 80° C. Then, 100 parts by weight of polymer 2 was added thereto and then subjected to high-speed stirring in a mechanical disperser provided with a circulation path, CLEARMIX (produced by M-Technique Co., Ltd.) to prepare a particle dispersion of polymer 2, having an average particle size of 110 nm.

Then, the internal temperature of the reactor was maintained at 80° C., while stirring under a nitrogen gas stream and the following monomer emulsion was added thereto.

| | |
|---|---|
| Styrene | 201 parts |
| n-Butyl acrylate | 100 parts |
| Methacrylic acid | 18 parts |
| Behenyl behenate | 172 parts |

While maintaining the internal temperature of the reactor at 80° C., a polymerization initiator solution of 10 g of potassium persulfate (KPS) dissolved in 190 parts by mass of pure water was added and after dropwise adding 5 parts by mass of n-octylmercaptan thereto, polymerization was undergone over 40 min. at the same temperature.

Subsequently, a polymerization initiator solution of 10 parts of potassium persulfate (KPS) dissolved in 190 parts of pure water was added into the reactor, and a monomer solution, as described below was dropwise added thereto over 1 hr. and polymerization was performed further over 1 hr.

| | |
|---|---|
| Styrene | 350 parts |
| n-Butyl acrylate | 165 parts |
| n-Octylmercaptan | 9 parts |

Thereafter, the reaction mixture was cooled to room temperature to obtain core resin particle 8. The thus obtained core resin particle 8, which was formed by use of the polymer 2 as both end (meth)acryloyl telechelic polymer, exhibited an average particle size of 220 nm and a number average molecular weight of 19,000.

(9) Preparation of Core Resin Particle 9

A dispersion of core resin particle 9 was prepared in the same manner as the core resin particle 1, except that the polymer 2 was not added in preparation of a monomer emulsion and the amount of n-butylacrylate vas varied to 117 parts by mass. The thus prepared core resin particle 9 exhibited an average particle size of 210 nm and a number average molecular weight of 17,000.

(10) Preparation of Core Resin Particle 10

A dispersion of core resin particle 10 was prepared in the same manner as the core resin particle 1, except that the polymer 2 was replaced by 1,4-butanediol diacrylate. The thus prepared core resin particle 10 exhibited an average particle size of 230 nm and a number average molecular weight of 18,200.

(11) Preparation of Core Resin Particle 11

A dispersion of core resin particle 11 was prepared in the same manner as the core resin particle 1, except that the polymer 2 was replaced by the polymer 4. The thus prepared core resin particle 11 exhibited an average particle size of 245 nm and a number average molecular weight of 18,000.

(12) Preparation of Core Resin Particle 12

A dispersion of core resin particle 12 was prepared in the same manner as the core resin particle 1, except that the polymerization initiator solution used therein was replaced by a solution of 2.5 parts by mass of potassium persulfate dissolved in 190 parts by mass of pure water, and the time of the first polymerization after addition of a monomer emulsion and the time of the second polymerization were extended to 60 min. and 90 min., respectively. The thus prepared core resin particle 12 exhibited an average particle size of 225 nm and a number average molecular weight of 50,000.

(13) Preparation of Core Resin Particle 13

A dispersion of core resin particle 13 was prepared in the same manner as the core resin particle 12, except that the time of the first polymerization after addition of a monomer emulsion and the time of the second polymerization were extended to 80 min. and 120 min., respectively. The thus prepared core resin particle 12 exhibited an average particle size of 220 nm and a number average molecular weight of 65,000.

(14) Preparation of Core Resin Particle 14

A dispersion of core resin particle 14 was prepared in the same manner as the core resin particle 1, except that the polymerization initiator solution used therein was replaced by a solution of 20 parts by mass of potassium persulfate dissolved in 190 parts by mass of pure water, and the time of the first polymerization after addition of a monomer emulsion and the time of the second polymerization were shortened to 30 min. and 45 min., respectively. The thus prepared core resin particle 142 exhibited an average particle size of 215 nm and a number average molecular weight of 5,000.

(15) Preparation of Core Resin Particle 15

A dispersion of core resin particle 15 was prepared in the same manner as the core resin particle 14, except that the time of the first polymerization after addition of a monomer emulsion and the time of the second polymerization were shortened to 20 min. and 30 min., respectively. The thus prepared core resin particle 15 exhibited an average particle size of 215 nm and a number average molecular weight of 4,000.

(16) Preparation of Core Resin Particle 16

A dispersion of core resin particle 16 was prepared in the same manner as the core resin particle 1, except the polymer 2 was replaced by the polymer 1. The thus prepared core resin particle 16 exhibited an average particle size of 210 nm and a number average molecular weight of 17,000.

(17) Preparation of Core Resin Particle 17

A dispersion of core resin particle 17 was prepared in the same manner as the core resin particle 1, except the polymer 2 was replaced by the polymer 3. The thus prepared core resin particle 17 exhibited an average particle size of 235 nm and a number average molecular weight of 50,200.

(18) Preparation of Core Resin Particle 18

A dispersion of core resin particle 18 was prepared in the same manner as the core resin particle 1, except the polymer 2 was replaced by the polymer 9. The thus prepared core resin particle 18 exhibited an average particle size of 245 nm and a number average molecular weight of 45,000.

(19) Preparation of Core Resin Particle 19

A dispersion of core resin particle 19 was prepared in the same manner as the core resin particle 1, except the polymer 2 was replaced by the polymer 5. The thus prepared core resin particle 19 exhibited an average particle size of 245 nm and a number average molecular weight of 63,000.

2-2. Preparation of Shell Resin Particle 1

Into a reactor equipped with a stirrer, a temperature sensor, a condenser and a nitrogen introducing device were added 2948 parts by mass of pure water and 2.3 parts of anionic surfactant, EMAL 2FG (produced by KAO Co., Ltd.) and dissolved. Then, the temperature was raised to 80° C. Further thereto, a polymerization initiator solution of 10 parts by mass of potassium persulfate (KPS) dissolved in 218 parts by mass of pure water was added with stirring under nitrogen gas stream, while maintaining a temperature within the reactor at 80° C. After adding the polymerization initiator solution, a monomer mixture solution of compounds described below was dropwise added over 3 hr., while stirring under nitrogen gas stream.

| | |
|---|---|
| Styrene | 520 parts |
| n-Butyl acrylate | 184 parts |
| Methacrylic acid | 96 parts |
| n-Octylmercaptan | 22 parts |

After completing addition of the monomer mixture solution, polymerization reaction was undergone at a temperature of 80° C. over 1 hr. and the reaction mixture was cooled to room temperature to prepare resin particles for shell (hereinafter, also denoted as shell resin particle). The thus prepared shell resin particle exhibited an average particle size of 82 nm and a weight average molecular weight of 13,200.

2-3. Preparation of Colorant Particle Dispersion C

To 160 parts by mass of deionized water was added 11.5 parts by mass of sodium dodecyl sulfate and dissolved to prepare an aqueous surfactant solution. To this aqueous surfactant solution was gradually added 25 parts by mass of C.I. Pigment Blue 15:3 and dispersed by using CLEARMIX W-MOTION CLM-0.8 (produced by M-Technique Co., Ltd.) to prepare a colorant particle dispersion C. A colorant particle C of the thus prepared colorant particle dispersion C exhibited an average particle size of 98 nm.

2-4. Preparation of Colored Particle 1-19

Colored particles 1-19 forming parent particles of toners 1-19 were each prepared in the manner, as described below.

(1) Preparation of Colored Particle 1

Into a reactor equipped with a stirrer, a temperature sensor, a condenser and a nitrogen introducing device was added the following composition and stirred:

| | |
|---|---|
| Core resin particle 1 | 1420 parts (solids) |
| Pure water | 820 parts |
| Colorant particle dispersion C | 150 parts (solids) |

After the temperature within the reactor was adjusted to 30° C., 5 liters of an aqueous 5 mol/l sodium hydroxide solution was added and the pH was adjusted to 10.

Subsequently, an aqueous solution of 20 parts by mass of magnesium chloride hexahydrate dissolved in pure water of 1000 parts by mass was dropwise added over 10 min., while stirring at 30° C. After completion of addition, the temperature was raised until reached 75° C. to undergo coagulation and fusion of the particles. Under this state, the size of coalesced particles was measured by MULTISIER 3 (produced by Beckman Coulter Co. When the volume-based median diameter of coalesced particles reached 6.5 μm, 210 parts (solids) of the shell resin particle 1 was added and coagulation/fusion was continued.

While undergoing coagulation and fusion, a small amount of solution was taken out from the reaction system and subjected to centrifugal separation in a centrifugal separator, and when the supernatant became transparent, an aqueous solution of 40 parts by mass of sodium chloride dissolved in 500 parts by mass was added thereto and stirring was further continued with heating. An average circularity was measured by using FPIA 2100 (produced by SYSMEX Corp.), while stirring with heating and when the average circularity reached 0.965, the temperature was lowered to room temperature. After repeating the washing procedure of washing thus prepared particles with pure water and filtration thereof, the obtained particles were dried to prepare colored particle 1 of a core/shell structure.

(2) Preparation of Colored Particles 2-19

Colored particles 2-19 were each prepared in the same manner as the foregoing Colored particle 1, except that Colored particle 1 was replaced by each of Colored particles 2-19, as shown in Table 2.

2-5. External Additive Treatment

An external additive, as shown below was added to each of the thus prepared Colored particles 1-19 and an external additive treatment was conducted using a HENSCHELL mixer to prepare Toners 1-19.

| | |
|---|---|
| Hexamethyldisilaxane-treated silica (average primary particle size: 12 nm) | 0.6 parts |
| n-Octylsilane-treated titanium oxide (average primary particle size: 24 nm) | 0.8 parts |

An external additive treatment using a HENSCHELL mixer was conducted was conducted at a circumferential speed of a stirring blade of 35 m/sec, a treatment temperature of 35° C. over a treatment time of 15 min.

Core resin particle (or resin particle for core) and polymer [or both end (meth)acryloyl telechelic polymer] used for each of Toners 1-19, and number average molecular weight (Mn) and Mw/Mn of the individual toner are shown in Table 2. As shown in Table 2, the number average molecular weight of a binder resin constituting each of toners was the same value as the number average molecular weight of the core resin particles used therein.

TABLE 2

| Toner No. | Core Resin Particle No. | Polymer No. | Polymer n (Median Value) | Binder Resin Mn | Binder Resin Mw/Mn |
|---|---|---|---|---|---|
| 1 | 1 | 2 | 40 | 18000 | 1.18 |
| 2 | 2 | 2 | 40 | 19500 | 1.18 |
| 3 | 3 | 6 | 250 | 22400 | 1.03 |
| 4 | 4 | 6 | 250 | 23200 | 1.02 |
| 5 | 5 | 6 | 250 | 23900 | 1.04 |
| 6 | 6 | 7 | 200 | 28500 | 1.16 |
| 7 | 7 | 8 | 250 | 25300 | 1.18 |
| 8 | 8 | 2 | 40 | 19000 | 1.18 |
| 9 | 9 | — | — | 17000 | 1.13 |
| 10 | 10 | * | — | 18200 | 1.12 |
| 11 | 11 | 4 | 20 | 18000 | 1.28 |
| 12 | 14 | 2 | 40 | 5000 | 1.18 |
| 13 | 15 | 2 | 40 | 4000 | 1.25 |
| 14 | 16 | 1 | 25 | 17000 | 1.20 |
| 15 | 17 | 3 | 400 | 50000 | 1.15 |
| 16 | 18 | 9 | 1000 | 45000 | 1.04 |
| 17 | 19 | 5 | 1500 | 63000 | 1.09 |
| 18 | 12 | 2 | 40 | 50000 | 1.18 |
| 19 | 13 | 2 | 40 | 65000 | 1.24 |

*1,4-butanediol

4. Evaluation (1) Preparation of Developer 1-19

A carrier comprised of ferrite particles covered with a styrene-acryl resin and having an average particle size of 35 nm was mixed with each of the foregoing toners 1-19 to prepare developers 1-19, each having a toner content of 8%.

(2) Evaluation Experiment

The foregoing toners 1-19 were each fed into an evaluation machine which was installed with a modified fixing device of a commercially available copier, bizhub PRO C500 (produced by Konica Minolta Business Technology Inc.) and evaluated with respect to fixing offset and fixing performance. Thus, using developers 1-8, 12, 14-16 and 18 (denoted as Examples 1-13) and developers 9-11, 13, 17 and 19 (denoted as Comparative Examples 1-6), evaluation was conducted with respect to fixing offset, fixability and thermal storage stability. The fixing device was modified so that the surface temperature of a heating roller for fixing was variable within the range of 105 to 210° C.

Fixing Offset:

The surface temperature of a heating roller for fixing was varied at intervals 5° C. in the range of 105 to 210° C. At the respective surface temperatures, an A4-sized image, carrying a 5 mm wide, solid black belt-formed image which was arranged vertically to the conveyance direction was longitudinally conveyed to be fixed; then, an A4 image having a 5 mm wide, solid black belt-formed image and a 20 mm wide halftone image which were arranged vertically to the conveyance direction was laterally conveyed and fixed. The temperature at which image staining due to fixing offset occurred was determined on the high temperature side and on the low temperature side. Samples which caused no image staining at a temperature higher than 200° C. on the high temperature side and at a temperature lower than 150° C. on the low temperature side were evaluated to be acceptable in practice.

Fixability:

Similarly to the evaluation of fixing offset, the surface temperature of a heating roller for fixing was varied at intervals 5° C. in the range of 105 to 210° C. to evaluate fixed images. Development was conducted so that the toner adhered to the transfer paper was 11 mg/cm$^2$ and the transfer paper having a toner image was fixed under an environment of 10° C. and 10% RH.

A fixed image portion of transfer paper was folded down by a folding machine and air at 0.35 MPa was sprayed onto the folded portion. The image at the folded portion was evaluated according to the following criteria. Evaluation was based on five rankings and the fixing temperature corresponding to rank 3 was defined as the lower limit of the fixing temperature. A lower fixing temperature limit of 150° C. or less was acceptable in practice.

Rank 5: no fold was observed,

Rank 4: slightly peeling was observed along the fold,

Rank 3: a thin linear peeling was observed along the fold but was judged to be acceptable in practice, Rank 2: a thick linear peeling was observed along the fold and judged to be unacceptable in practice, Rank 1: a large peeling being caused on the image.

Thermal Storage Stability:

Each of the toners was also evaluated with respect to thermal storage stability, according to the following procedure. Into a 10 ml vial having an inner diameter of 21 mm was placed each toner and after closing the lid, each vial was then shaken 600 times in tap densor, KYT-2000 (produced by Seishin Kigyo Co., Ltd.) and after removing the lid, the vial was allowed to stand for two hours, under an environment of 57° C. and 35% RH. Subsequently, the toner was placed on a sieve of 48 mesh (350 μm aperture) without damaging the toner and set to Powder Tester (produced by Hosokawa Micron Co., while being fixed by a pressure bar and a knob nut.

The Powder Tester was adjusted to a vibration intensity of a 1 mm feeding width and vibration was applied thereto for 10 sec. Thereafter, the amount of toner remaining on the sieve was measured and the ratio of the remaining toner was calculated to determine the toner aggregation ratio (the ratio of aggregated toner particles, in %).

The toner aggregation ratio was determined according to the following equation:

$$\text{Toner aggregation ratio(\% by mass)}=\{[\text{mass of toner remaining on sieve(g)}]/0.5(\text{g})\}\times 100.$$

Thermal storage stability was evaluated based on the following criteria:

A: a toner aggregation ratio of less than 15% by mass (being excellent in thermal storage stability), B: a toner aggregation ratio of not less than 15% by mass and not more than 20% by mass (being superior in thermal storage stability), C: a toner aggregation ratio of more than 20% (being inferior in thermal storage stability, unacceptable in practice).

The above evaluation results are shown in Table 3.

TABLE 3

| | | Core | Polymer | | | | Thermal Storage Stability | |
|---|---|---|---|---|---|---|---|---|
| | Toner No. | Resin Particle No. | No. of Formula (1) | High-temperature Side Offset | Low-temperature Side Offset | Lower Limit Of Fixing Temperature | Toner Aggregation Ratio (%) | Evaluation |
| Example 1 | 1 | 1 | 2 | >210° C.* | 130° C. | 135° C. | 8 | A |
| Example 2 | 2 | 2 | 2 | >210° C. | 120° C. | 125° C. | 9 | A |
| Example 3 | 3 | 3 | 6 | >210° C. | 125° C. | 130° C. | 8 | A |
| Example 4 | 4 | 4 | 6 | >210° C. | 120° C. | 125° C. | 9 | A |
| Example 5 | 5 | 5 | 6 | >210° C. | 120° C. | 125° C. | 9 | A |
| Example 6 | 6 | 6 | 7 | >210° C. | 115° C. | 120° C. | 10 | A |
| Example 7 | 7 | 7 | 8 | >210° C. | 120° C. | 125° C. | 10 | A |
| Example 8 | 8 | 8 | 2 | >210° C. | 115° C. | 120° C. | 11 | A |
| Example 9 | 12 | 14 | 2 | 200° C. | 110° C. | 115° C. | 16 | B |
| Example 10 | 14 | 16 | 1 | 205° C. | 115° C. | 120° C. | 16 | B |
| Example 11 | 15 | 17 | 3 | * | 135° C. | 140° C. | 10 | A |
| Example 12 | 16 | 18 | 9 | * | 145° C. | 150° C. | 9 | A |
| Example 13 | 18 | 12 | 2 | * | 150° C. | 150° C. | 12 | A |
| Comparative Example 1 | 9 | 9 | — | 190° C. | 155° C. | 170° C. | 36 | C |
| Comparative Example 2 | 10 | 10 | ** | 195° C. | 155° C. | 165° C. | 33 | C |
| Comparative Example 3 | 11 | 11 | 4 | 190° C. | 115° C. | 120° C. | 27 | C |
| Comparative Example 4 | 13 | 15 | 2 | 180° C. | 110° C. | 115° C. | 25 | C |
| Comparative Example 5 | 17 | 19 | 5 | 205° C. | 155° C. | 160° C. | 17 | B |
| Comparative Example 6 | 19 | 13 | 2 | >210° C. | 165° C. | 160° C. | 17 | B |

*More than 210° C.,

**1,4-Butanediol

As is shown in Table 3, it was proved that Examples 1-13 using a toner according to the present invention achieved enhanced fixability, and both improved offset resistance and enhanced low temperature fixability were achieved in view of the fact that no offsetting occurred over a broad temperature range. Further, improved thermal storage stability of a toner was also achieved and it is presumed that the constitution of the invention formed a uniform shell on the core surface, whereby improved thermal storage stability was achieved. On the contrary, Comparative Examples 1-6 did not achieve improved offset resistance and enhanced low temperature fixability together. Further, in some of comparative examples, a prescribed thermal storage stability was not achieved.

What is claimed is:

1. A method of preparing a toner comprising a binder resin and a colorant, the method comprising:

forming resin particles containing a resin (A) formed by allowing a styrene monomer, a (meth)acryl monomer and a polymer represented by the following formula (1) to react, and mixing the resin particles with colorant particles which were dispersed and allowing the resin particles and the colorant particle to coagulate and fuse to form toner particles;

$$X—(Y)_n—X \qquad \text{formula (1)}$$

wherein X is at least one of an acryloyl group and a methacryloyl group, Y is a radical polymerizable monomer unit and n is an integer of 25 to 1000, and wherein the resin (A) is formed by a process comprising dispersing the styrene monomer and the (meth)acryl monomer in an aqueous medium and polymerizing said monomers in the presence of the polymer of the formula (1) in the aqueous medium.

2. The method of claim 1, wherein the polymer of the formula (1) exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2.

3. The method of claim 1, wherein the polymer of the formula (1) is a polymer which is synthesized by a process of living radical polymerization.

4. The method of claim 1, wherein the binder resin contains the resin (A) in an amount of not less than 0.5% by mass and not more than 20% by mass of the binder resin.

5. A toner comprising a binder resin and a colorant and formed by allowing at least resin particles and colorant particles to coagulate and fuse, wherein the resin particles comprise a resin (A) formed by allowing a polymer represented by the following formula (1), a styrene monomer and a (meth) acryl monomer to react:

$$X—(Y)_n—X \qquad \text{formula (1)}$$

wherein X is at least one of an acryloyl group and a methacryloyl group, and n is an integer of 25 to 1000, and the binder resin exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2.

6. The toner of claim 5, wherein the polymer of the formula (1) exhibits a number average molecular weight (Mn) of not less than 5,000 and not more than 50,000 and a ratio (Mw/Mn) of weight average molecular weight (Mw) to number average molecular weight (Mn) of not less than 1.0 and not more than 1.2.

7. The toner of claim 5, wherein the polymer of the formula (1) is a polymer which is synthesized by a process of living radical polymerization.

8. The toner of claim 5, wherein the binder resin contains the resin (A) in an amount of not less than 0.5% by mass and not more than 20% by mass of the binder resin.

9. A developer comprising a toner, as claimed in claim 5.

* * * * *